US007186935B2

(12) United States Patent
Lee et al.

(10) Patent No.: US 7,186,935 B2
(45) Date of Patent: Mar. 6, 2007

(54) KEYPAD ASSEMBLY FOR A PORTABLE TERMINAL

(75) Inventors: Joo-Hoon Lee, Yongin-si (KR); Sun-Tae Jung, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/332,698

(22) Filed: Jan. 13, 2006

(65) Prior Publication Data

US 2007/0012553 A1 Jan. 18, 2007

(30) Foreign Application Priority Data

Jul. 15, 2005 (KR) ..... 10-2005-0064356

(51) Int. Cl.
*H01H 9/00* (2006.01)

(52) U.S. Cl. ..... 200/310; 200/311; 200/313; 200/314

(58) Field of Classification Search ..... 200/310
See application file for complete search history.

(56) References Cited

U.S. PATENT DOCUMENTS 4,346,275 A * 8/1982 Iwakiri et al. ..... 200/314
4,419,555 A * 12/1983 Kim ..... 200/314
5,099,094 A * 3/1992 Torma et al. ..... 200/296
5,113,047 A * 5/1992 Tsutsumi ..... 200/407
2005/0150753 A1* 7/2005 Hsu ..... 200/314
2006/0038769 A1* 2/2006 Marra et al. ..... 345/102

* cited by examiner

*Primary Examiner*—Elvin Enad
*Assistant Examiner*—Lheiren Mae A. Anglo
(74) *Attorney, Agent, or Firm*—Cha & Reiter, L.L.C.

(57) ABSTRACT

A keypad assembly for a portable terminal is disclosed. The keypad assembly for the portable terminal includes a light guide plate which has reflection patterns locally formed on a lower surface of the light guide plate for reflecting a part of light transmitted in the light guide plate toward an upper surface of the light guide plate. The keypad assembly also includes at least one key button seated on the light guide plate, for outputting the light reflected by the reflection patterns out of the keypad assembly, upper and lower cases for containing the light guide plate, a switch substrate seated on a bottom surface of the lower case and having at least one switch, and an extension member which extends from an upper case of the portable terminal toward the switch substrate. The extension member has a reflection filter for reflecting the light exiting from the light guide plate toward the light guide plate back. The reflection filter is formed on an inner surface facing a side surface of the light guide plate.

11 Claims, 2 Drawing Sheets

KEYPAD ASSEMBLY FOR A PORTABLE TERMINAL

CLAIM OF PRIORITY

This application claims priority to an application entitled "Keypad Assembly," filed with the Korean Intellectual Property Office on Jul. 15, 2005 and assigned Serial No. 2005-64356, the contents of which are incorporated herein by reference.

BACKGROUND OF THE INVENTION

1. Field of the Invention

The present invention relates to a keypad assembly for a portable terminal, and more particularly to a keypad assembly for a portable terminal that includes a light guide plate.

2. Description of the Related Art

Generally, a keypad assembly for a conventional portable terminal includes a keypad and a switch substrate. The keypad includes a plate-shaped elastic layer and a plurality of key buttons formed on a first surface of the elastic layer. In the keypad, characters, numbers and symbols are respectively printed on a surface of each key button. The switch substrate has a plurality of switches integrated therewith to provide electric contact as each key button is pushed. In this way, it is possible to convert a depression of the respective key buttons into an electric signal.

A portable terminal has lighting elements for a user to use the keypad even in the dark. A plurality of light emitting diodes and inorganic electro luminescence may be used as the lighting elements. The light emitting diodes are generally arranged on a printed circuit board, while the inorganic electro luminescence is inserted in an elastic pad.

FIG. 1 is a sectional view showing a conventional keypad assembly 100. FIG. 2 is a plan view showing the keypad assembly 100 shown in FIG. 1. The conventional keypad assembly 100 includes a keypad 130, a light guide plate 140, a light source 150, a switch substrate 120 and upper and lower cases 111 and 112. The keypad 130 includes an elastic layer 132 and key buttons 210 formed on the elastic layer 132. The light guide plate 140 is placed under the keypad 130. The light source 150 is disposed at a side of the light guide plate 140 to emit light into the light guide plate 140.

The key buttons 131 may be either integrally formed on the elastic layer 132 or attached to the elastic layer 132 after being formed separately. When a user releases a press to any key button 131 after a key operation, the elastic layer 132 makes the key button 131 recover to an initial state.

The switch substrate 120 includes a dome sheet 121 and a printed circuit board 122. The dome sheet 121 has a plurality of dome switches 123 each of which corresponds to each key button 131. The dome sheet 121 is seated on an upper surface of the printed circuit board 122. The printed circuit board 122 has a plurality of electric contacts each of which can come into contact with each dome switch 123.

The light guide plate 140 has pressing protrusions 142 that are formed on a lower surface thereof to face each dome switch 123. The light guide plate 140 also has reflection patterns 141 that are respectively formed around each pressing protrusion 142 in order to reflect a part of light toward the key buttons 131. A part of the light transmitted in the light guide plate 140 is reflected by means of the reflection patterns 141 toward the key buttons 131, while the rest of the light exits out of the light guide plate 140 to the atmosphere.

However, the light exiting out of the light guide plate illuminates not only the key buttons but also other elements, which causes light loss. Also, this light loss causes the user's eyes to be diverted or distracted to other elements besides the key buttons.

SUMMARY OF THE INVENTION

One aspect of the present invention relates to a keypad assembly for a portable terminal that can reduce light loss due to light exiting without illumination for key buttons while improving brightness and illumination of light for the key buttons with a minimum number of light sources.

One embodiment of the present invention is directed to a keypad assembly for a portable terminal. The keypad includes a light guide plate that has reflection patterns locally formed on a lower surface of the light guide plate, for reflecting a part of light transmitting in the light guide plate toward an upper surface of the light guide plate and at least one key button that is seated on the light guide plate, for outputting the light reflected by the reflection patterns out of the keypad assembly. The keypad also includes upper and lower cases for containing the light guide plate, a switch substrate seated on a bottom surface of the lower case and having at least one switch and an extension member which extends from an upper case of the portable terminal toward the switch substrate. The extension has a reflection filter for reflecting the light exiting from the light guide plate toward the light guide plate back. The reflection filter is formed on an inner surface facing a side surface of the light guide plate.

BRIEF DESCRIPTION OF THE DRAWINGS

The above and other aspects, features, and embodiments of the present invention will be more apparent from the following detailed description taken in conjunction with the accompanying drawings, in which.

DETAILED DESCRIPTION

Hereinafter, embodiments of the present invention will be described with reference to the accompanying drawings. In the following description of the present invention, a detailed description of known functions and configurations incorporated herein is omitted to avoid obscuring the subject matter of the present invention.

Figure 1:
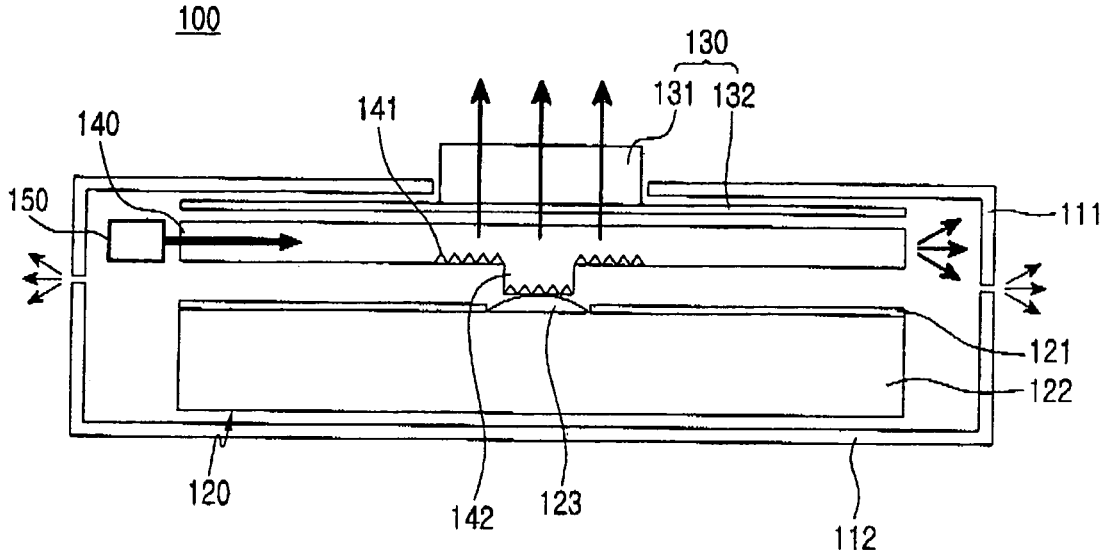
FIG.1 (PRIOR ART)
FIG. 1 is a sectional view showing a keypad assembly for a conventional portable terminal.
Figure 2:
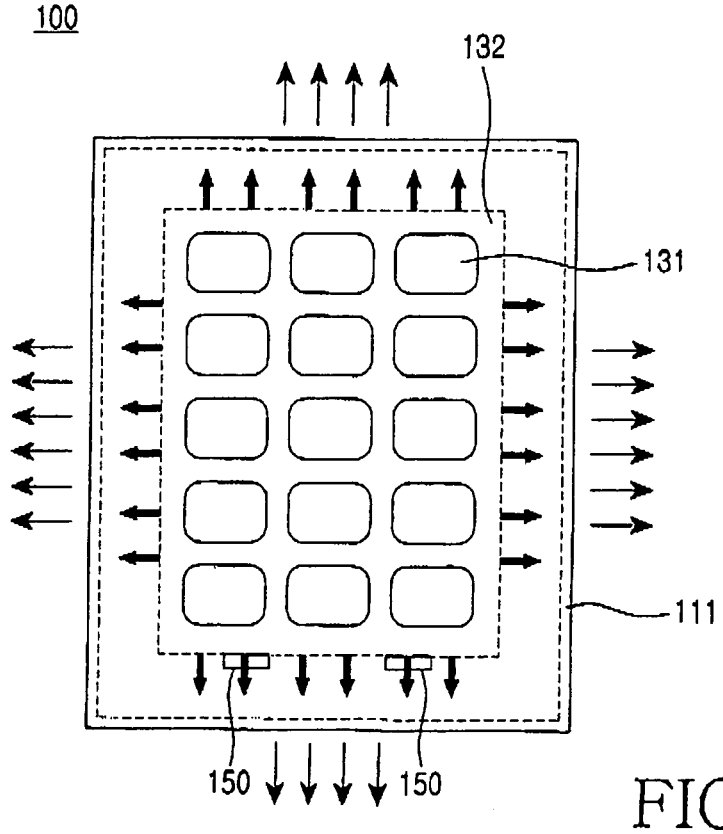
FIG. 2 is a plan view showing the keypad assembly for the portable terminal shown in FIG. 1, in which key buttons are arranged.
Figure 3:
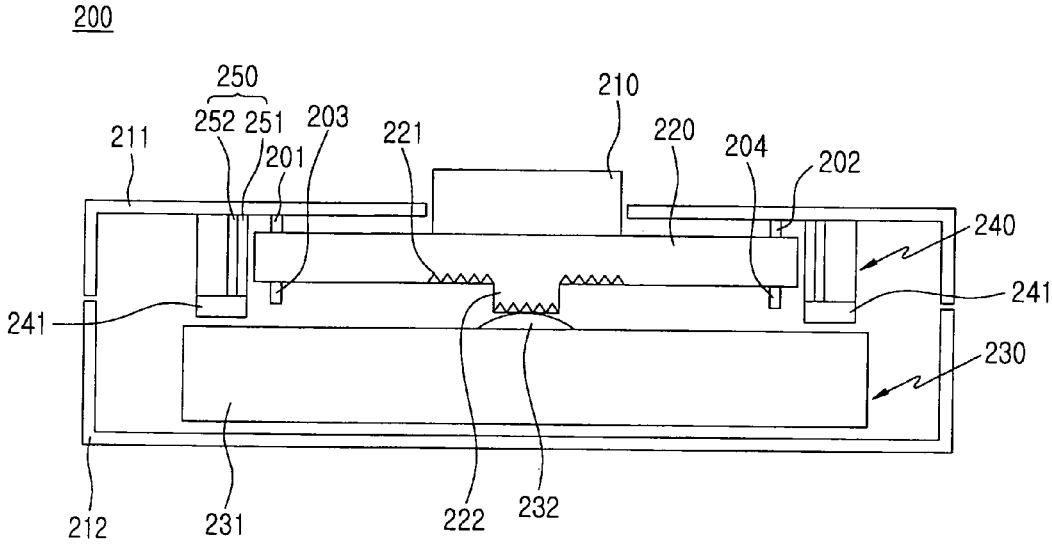
FIG. 3 is a sectional view showing a keypad assembly for a portable terminal according to the preferred embodiment of the present invention.
Figure 4:
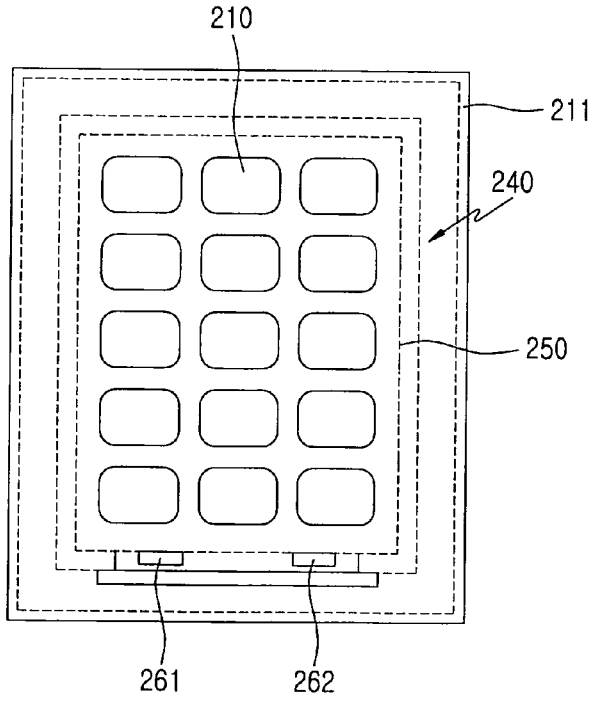
FIG. 4 is a plan view showing the keypad assembly for the portable terminal according to the preferred embodiment of the present invention shown in FIG. 3.

FIG. 3 is a sectional view showing a keypad assembly 200 for a portable terminal according to an embodiment of the present invention. Referring to FIGS. 3 and 4, the keypad assembly 200 according to this embodiment includes a light guide plate 220 having reflection patterns 221 that are locally formed on a lower surface thereof in order to reflect a part of light transmitting in the light guide plate 220 toward an upper surface of the light guide plate 220. The keypad assembly 200 also includes at least one key button 210 that is seated on the light guide plate 220 to transmit the light reflected by means of the reflection patterns 221 out of the light guide plate 220, upper and lower cases 211 and 212, a switch substrate 232 that is disposed on a bottom surface of the lower case 212 and has at least one switch 232 corresponding each key button 210, and extension members 240.

The light guide plate 220 has upper and lower surfaces opposite and parallel to each other. The light guide plate 220 includes pressing protrusions 222 formed on the lower surface thereof to improve a sense of touch of the key buttons and the reflection patterns 221 locally formed around each pressing protrusion 222. The light guide plate 220 may have any shape including a square, as shown.

The light transmitted in the light guide plate 220 is totally reflected at a boundary between the light guide plate 220 and the atmosphere and then transmitted from one side to an opposite side of the light guide plate 220. While the conventional light guide plates, discussed above, have been made from polycarbonate or acryl-based resin, which has high transmittance of visual rays, in a method of injection molding, the light guide plate 220 may be made from synthetic resin having high transmittance, such as polyurethane, silicone and the like, in order to enable the key operation.

The respective reflection patterns 221 reflect a part of the light transmitting through the light guide plate 220 toward the corresponding key button 210. Even though the light transmitted in the light guide plate 220 by the total reflection is introduced into the reflection patterns 221, a part of the light is subjected to a diffused-reflection by means of the reflection patterns 221. Most of the diffusively reflected light is transmitted through the key buttons 210 and exits to the atmosphere because the diffusively reflected light cannot satisfy a total reflection condition (i.e. because an incident angle is smaller than a critical angle). Thus, the reflection patterns 221 reflect the light by the diffused-reflection in any direction to provide the key buttons 210 with the uniform illumination.

The reflection patterns 220 can be preferably formed by scratching the light guide plate 220, or printed on the light guide plate 220. Where the light guide plate 220 implies optical fiber array, the reflection patterns 221 extend from a lower surface of the optical fiber array to a surface of cores.

On the other side, the totally reflected light and a part of the light subjected to the diffusively reflection by means of the reflection patterns 221 satisfy the total reflection condition while being continuously transmitted in the light guide plate 220. A part of the light transmitted in the light guide plate 220 illuminates other key buttons 210, while the rest of the light exits through the other side of the light guide plate 220.

The respective key buttons 210 may have a character, a symbol or a number printed on a surface thereof. The key buttons 210 may be made from material such as polycarbonate and acryl-based resin before the key buttons 210 are attached to the light guide plate 220. Further, the key buttons 210 may be formed in any shape including circle, oval, square and the like, if necessary.

The upper and lower cases 211 and 212 contain the light guide plate 220 and a switch substrate 230, which can be made in an extrusion method. The upper case 211 supports the light guide plate 220 in order that the key buttons 210 penetrate the upper case 211. The lower case 212 receives the switch substrate 230 in a bottom thereof.

The extension member 240 extends from the upper case 211 toward the switch substrate 230 while surrounding a circumference of the light guide plate 220. The extension member 240 has a reflection filter 250 on an inner surface thereof facing the side surface of the light guide plate 220. The reflection filter 250 reflects the light, which exits from the side surface of the light guide plate 220, toward the light guide plate 220. An elastic member 241 having elasticity is disposed on an end surface (i.e. a portion contacting with the switch substrate) of the extension member 241, which may be made of sponge or rubber material having the elasticity. The elastic member 241 may be made of material having black color in order to reduce the light leakage between the extension member 240 and the switch substrate 230, i.e. to prevent the light from leaking out of the extension member 240.

The reflection filter 250 includes a white layer and a black layer, which is formed by painting or coating the white and black layers. However, a tape type reflection filter 250 may be attached to the extension member 240. The reflection filter 250 faces the light guide plate 220, of which the white layer 251 reflects the light, which exits from the light guide plate 250, toward the light guide plate 250 while the black layer 252 is formed between the white layer 251 and the inner surface of the extension member 240 to absorb a part of the light transmitting through the white layer 251.

The switch substrate 230 includes a plate-shaped printed circuit board 231 on which at least one switch 232 corresponds to each key button 210. The switches 232 can convert a depression of the respective key buttons 210 into an electric signal. In this embodiment, the respective switches 232 have a conductive contact member and a dome fully covering the contact member.

When a user pushes any one key 210, the pressing protrusion 222 of the light guide plate 220 disposed below the key button 210 is urged toward the switch substrate 230, resulting in pressing the corresponding switch 232. The pressed switch 232 comes in electric contact with the corresponding contact member.

It should be appreciated that embodiments of the present invention can reduce the light loss by introducing the light, which exits from the side surface of the light guide plate without illuminating the key buttons, into the light guide plate again. Furthermore, embodiments of the present invention can improve brightness and illumination for the key buttons without increasing the light source.

Accordingly, the portable terminal employing an embodiment of the present invention can save electric power and improves an available time of the electric source.

While the invention has been shown and described with reference to certain embodiments thereof, it will be understood by those skilled in the art that various changes in form and details may be made therein without departing from the spirit and scope of the invention as defined by the appended claims.

What is claimed is:

1. A keypad assembly comprising:

a light guide plate having reflection patterns locally formed on a lower surface of the light guide plate for reflecting a part of light transmitting in the light guide plate toward an upper surface of the light guide plate;

at least one key button seated on the light guide plate for outputting the light reflected by the reflection patterns out of the keypad assembly;

upper and lower cases for containing the light guide plate;

a switch substrate seated on a bottom surface of the lower case and having at least one switch; and an extension member that extends from an upper case of the key pad toward the switch substrate, the extension member having a reflection filter that is configured to reflect light exiting from the light guide plate back toward the light guide plate and that is formed on an inner surface of the extension member, facing a side surface of the light guide plate.

2. The keypad assembly as claimed in claim 1, wherein the reflection filter includes a white layer that faces the light guide plate, for reflecting the light exiting from the light guide plate toward the light guide plate, and a black layer that is formed between the white layer and the inner surface of the extension member for absorbing a part of the light transmitted through the white layer.

3. The keypad assembly as claimed in claim 2, wherein the white and black layers are formed in a manner of painting or coating.

4. The keypad assembly as claimed in claim 1, wherein the extension member further includes an elastic member that has elasticity and is formed on an end surface of the extension member contacting with the switch substrate.

5. The keypad assembly as claimed in claim 4, wherein the elastic member is made of a sponge or a rubber material.

6. A keypad assembly comprising:

a light guide plate that has reflection patterns locally formed on a lower surface of the light guide plate for reflecting some of light transmitted in the light guide plate toward an upper surface of the light guide plate;

at least one key button that is seated on the light guide plate, for outputting the light reflected by the reflection patterns out of the keypad assembly;

upper and lower cases for containing the light guide plate; and a switch substrate seated on a bottom surface of the lower case and having at least one switch, wherein the keypad assembly further includes an extension member which extends from an upper case of the key pad toward the switch substrate while having a reflection filter that is formed on an inner surface of the extension member, facing a side surface of the light guide plate and that is configured to reflect light exiting from the light guide plate back toward the light guide plate.

7. A portable terminal including a keypad assembly comprising:

a light guide plate that includes a plurality of reflection patterns arranged to reflect light transmitting in the light guide plate toward a surface of the light guide plate;

at least one key button position to output the light reflected by the plurality of reflection patterns out of the keypad assembly;

a housing arranged to support the light guide plate;

a switch substrate position on a first surface of the housing and having at least one switch; and a member supported by the housing that extends toward the switch substrate, the member having a reflection filter that is configured to reflect the light exiting from the light guide plate back toward the light guide plate and that is formed on an inner surface of the member, facing a side surface of the light guide plate.

8. The portable terminal as claimed in claim 7, wherein the reflection filter includes a white layer that faces the light guide plate for reflecting the light exiting from the light guide plate toward the light guide plate, and a black layer that is formed between the white layer and the inner surface of the extension member for absorbing a part of the light transmitted through the white layer.

9. The portable terminal as claimed in claim 8, wherein the white and black layers are formed in a manner of painting or coating.

10. The portable terminal as claimed in claim 7, wherein the member further includes an elastic member that has elasticity and is formed on an end surface of the member contacting with the switch substrate.

11. The portable terminal as claimed in claim 10, wherein the elastic member is made of a sponge or a rubber material.

* * * * *